United States Patent [19]

Hartness

[11] 4,215,521

[45] Aug. 5, 1980

[54] ARTICLE RETARDING DEVICE FOR CASE LOADING MACHINE

[76] Inventor: Thomas S. Hartness, Rte. 12, Paris Mtn., Greenville, S.C.

[21] Appl. No.: 940,373

[22] Filed: Sep. 7, 1978

[51] Int. Cl.[2] ..... B65B 21/16

[52] U.S. Cl. ..... 53/248; 53/262

[58] Field of Search ..... 53/248, 257, 260, 261, 53/262; 193/32, 40

[56] References Cited

U.S. PATENT DOCUMENTS

| | | | |
|---|---|---|---|
| 2,656,081 | 10/1953 | Davis | 53/248 X |
| 3,788,034 | 1/1974 | Hartness et al. | 53/248 |
| 3,911,647 | 10/1975 | Hartness et al. | 53/248 |

*Primary Examiner*—Travis S. McGehee

*Attorney, Agent, or Firm*—Bailey, Dority & Flint

[57] ABSTRACT

An article retarding device for use with a grid set of a case loading machine for breaking the fall of articles as they are dropped through the grid set into a case. The grid set includes a trip-bar assembly which is shifted to drop the articles. Positioned below the trip-bar assembly are a plurality of pivotally supported downwardly extending fingers carried in the form of a matrix which guide the articles into the case as they are being loaded. A camming mechanism selectively forces the fingers of respective passages to the center of the passages for breaking the fall of articles into the case. Means is provided for retracting the camming mechanism to a second position so that the articles can be gently loaded into the case.

5 Claims, 8 Drawing Figures

Fig. 3.
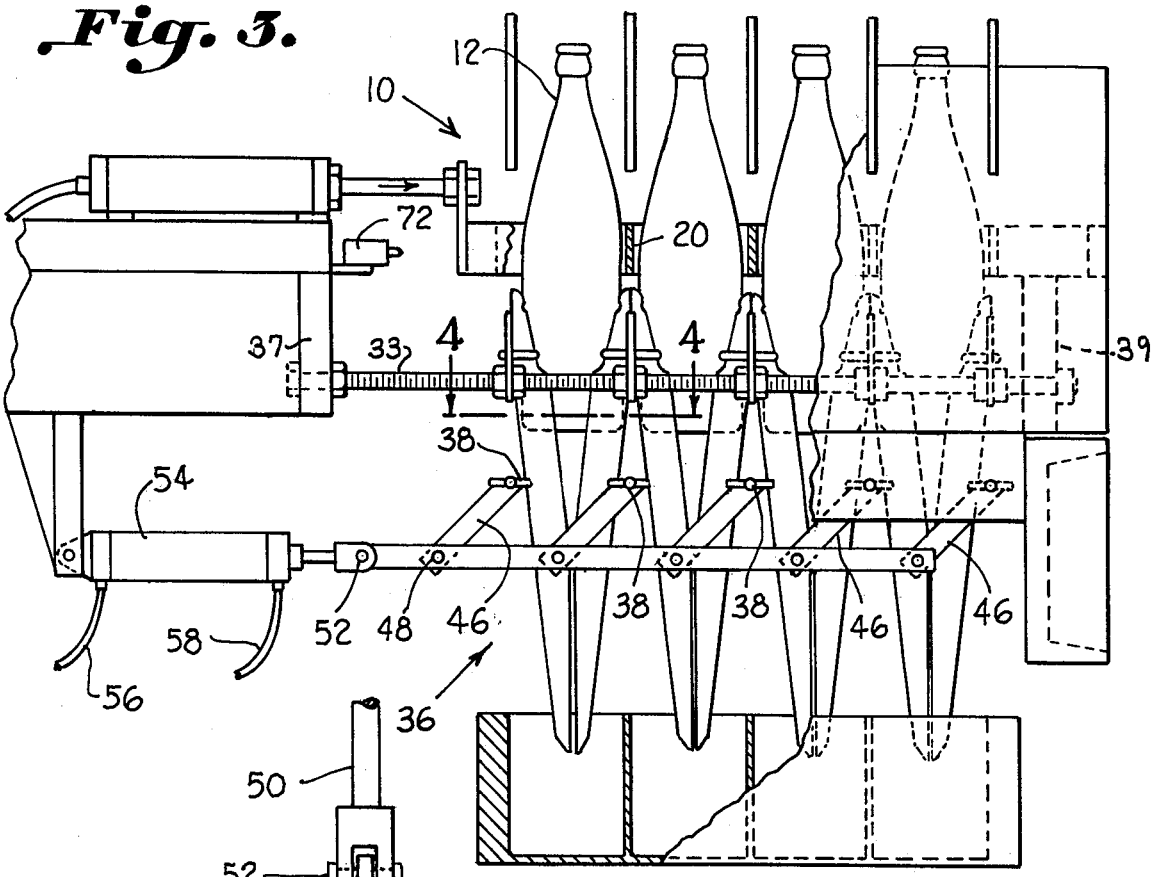
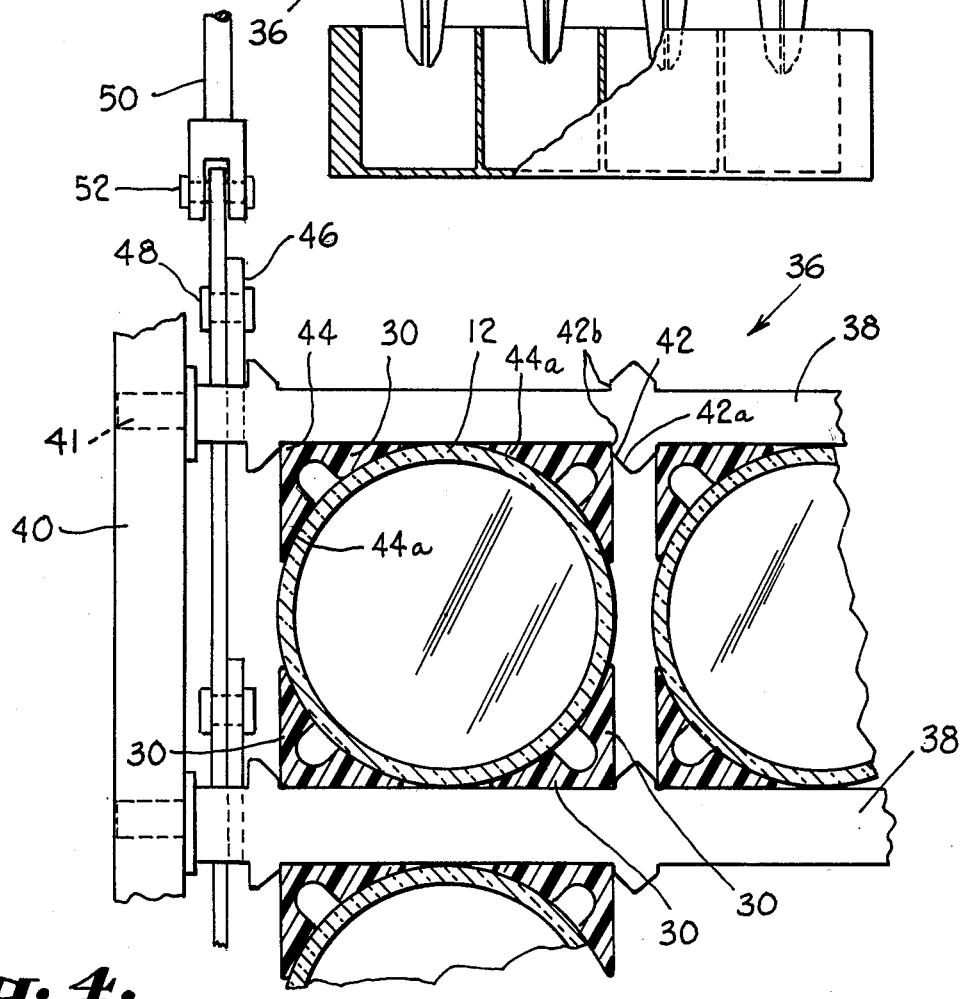
Fig. 4.

ARTICLE RETARDING DEVICE FOR CASE LOADING MACHINE

BACKGROUND OF THE INVENTION

It is well known to utilize fingers below a grid set of a case loading machine so as to guide articles such as bottles into respective compartments of a case. In U.S. Pat. Nos. 3,788,034 and 3,911,647, rigid downwardly extending fingers are carried in the corner of passages provided below a trip-bar assembly. As the articles are dropped through these passages, they engage the fingers which guide the travel of the articles into the case. In one particular machine, the case that is to be loaded is carried on an elevator and raised directly beneath the grid set to a loading position. Even though the case is in a raised position, as the bottles drop through the grid set and fingers, they strike the case with a substantial force often breaking the bottles. Furthermore, the dropping of the bottles from the grid set to the case creates a substantial amount of noise.

SUMMARY OF THE INVENTION

The invention pertains to an article retarding device for use with grid sets for breaking the fall of articles as they are dropped through the grid into a case. The grid set includes a trip-bar assembly onto which the articles are fed. A plurality of pivotally supported downwardly extending fingers are carried in the form of a matrix below the trip-bar assembly. The downwardly extending fingers are arranged to define a plurality of passages through which the bottles pass when being loaded into the case. A finger is carried in the corner of each of the respective passages so that when the trip-bar assembly is shifted, the articles drop through the passages engaging the fingers for being guided into the case. In order to retard or stop the articles as they are being dropped through the passages, cam means engage the fingers forcing the fingers of each respective passage towards the center of that particular passage. This breaks the fall of the article in the case. Means is provided for retracting the cam means to a second position for allowing the fingers to be retracted back into the corners of the passages permitting the articles to be dropped into the case. Thus, the articles are gently deposited in the case, minimizing breakage and noise.

Accordingly, it is an important object of the present invention to provide a device for breaking the fall of articles such as bottles as they are dropped through a case loading machine into cases.

Still another important object of the present invention is to reduce the noise inherent in case loading machines by breaking the fall of articles as the articles are loaded into a case.

Still another important object of the present invention is to provide a device for breaking or retarding the fall of bottles into a case so as to minimize breakage of the articles during the loading of the case.

These and other objects and advantages of the invention will become apparent upon reference to the following specification, attendant claims, and drawings.

BRIEF DESCRIPTION OF THE DRAWINGS

FIG. 3 is a side elevational view of a grid set forming part of a case loading machine illustrating camming mechanisms forcing the fingers towards the center of passages for preventing bottles from dropping completely therethrough;

FIG. 4 is a sectional view, taken along line 4—4 of FIG. 3;

DESCRIPTION OF A PREFERRED EMBODIMENT

Figure 1:
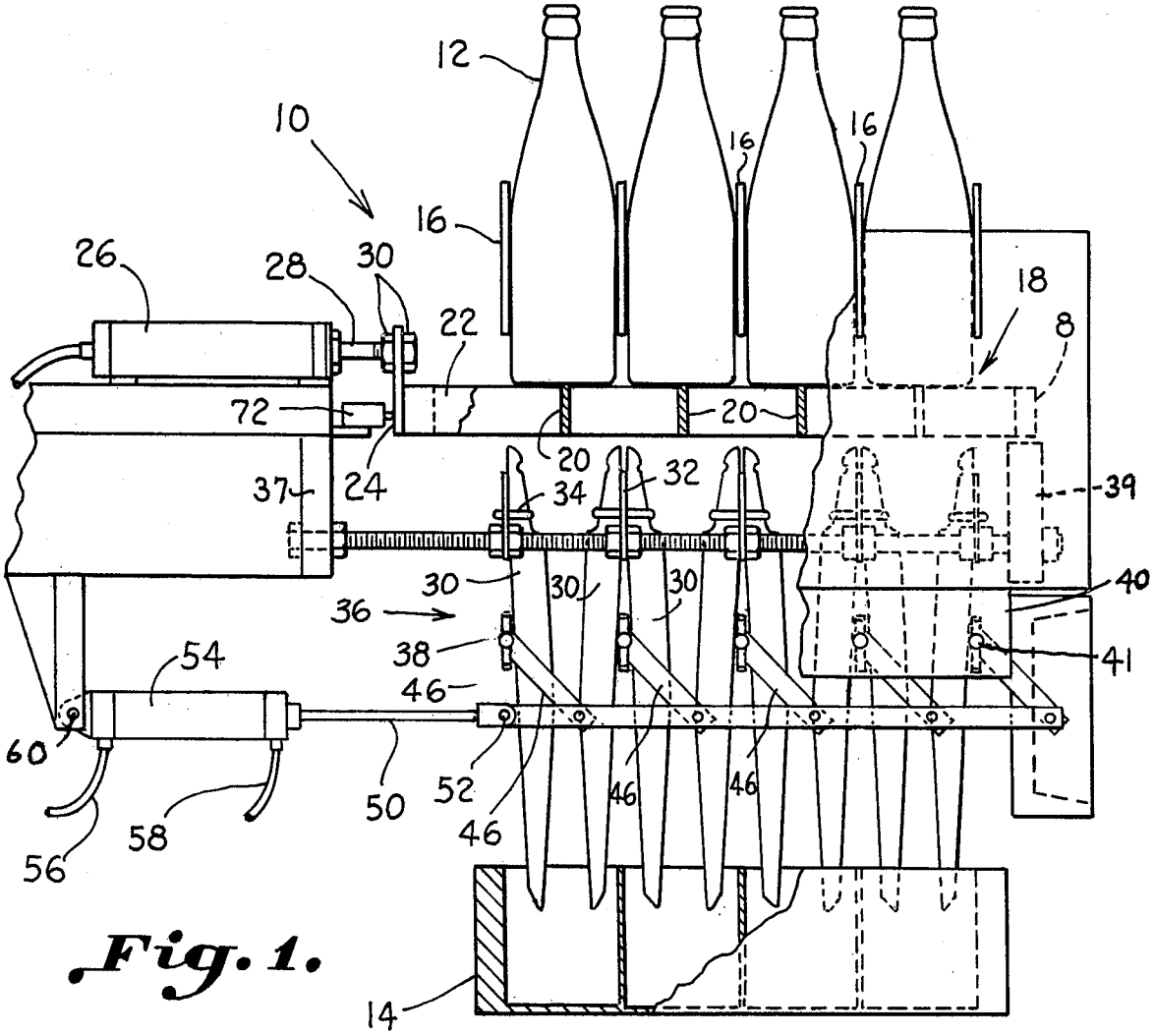
FIG. 1 is a side elevation view partially in section, illustrating a grid set of a case loading machine incorporation an article retarding device constructed in accordance with the present invention.

Referring to FIG. 1 of the drawings, there is illustrated generally by the reference character 10, a portion of the grid set that may be used for loading articles such as bottles into a case or cartons carried within the case. One such bottle loading machine is illustrated in U.S. Pat. No. 3,788,034. Bottles 12 are carried in aligned rows above the grid set 10 for being dropped through the grid set 10 into a case 14 or into cardboard cartons carried in a case. Normally, there are four rows of bottles.

The bottles are separated by divider plates 16 as they are fed onto a trip-bar assembly 18. The trip-bar assembly 18 includes a plurality of laterally spaced bars 20 carried between spaced side walls 22 that are joined by end walls 24 to produce a substantially square frame. A pneumatically operated cylinder 26 is provided for shifting the trip-bar assembly laterally from the position shown in FIG. 1 to the position shown in FIG. 3 for dropping the bottles. As seen in FIG. 1, the bottles, prior to being dropped, are supported on the spaced bars 20.

The cylinder 26 has a rod 28 extending out the end thereof that is connected by means of nuts 30 to a vertically extending flange forming part of the side wall 24 of the trip-bar assembly. It is to be understood that the trip-bar assembly could be any suitable conventional trip-bar assembly utilized in connection with article loading machines.

A plurality of pivotally supported downwardly extending fingers are carried below the trip-bar assembly in the form of a matrix for guiding the bottles as they are dropped into the case 14. The fingers 30 may be any suitable rigid fingers such as disclosed in U.S. Letters Pat. Nos. 3,911,647 and 3,788,034. These fingers are attached to laterally spaced bars 32 by means of a lock ring 34. The manner in which the fingers 30 are supported on the bars 32 is described and illustrated in detail in U.S. Pat. No. 3,911,647.

Figure 8:
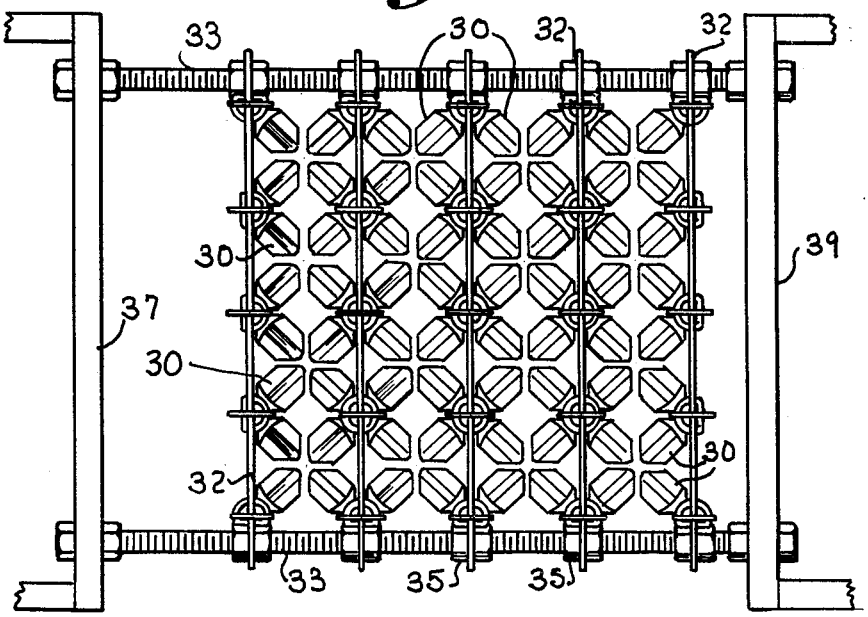
FIG. 8 is a plan view illustrating a set of fingers.

As illustrated in FIGS. 4 and 8, within the corner of each passage, there is a finger 30 which guides the bottle 12 as it drops through the respective passage into the case 14. The bars 32 have holes adjacent the ends thereof through which threaded rods 33 extend. Nuts 35 are threaded on the rods 33 pressing against opposed sides of the bars 32 for securely supporting the bars. The rods 33 are, in turn, supported on portions 37 and 39 of the frame of the case loading machine.

Figure 2:
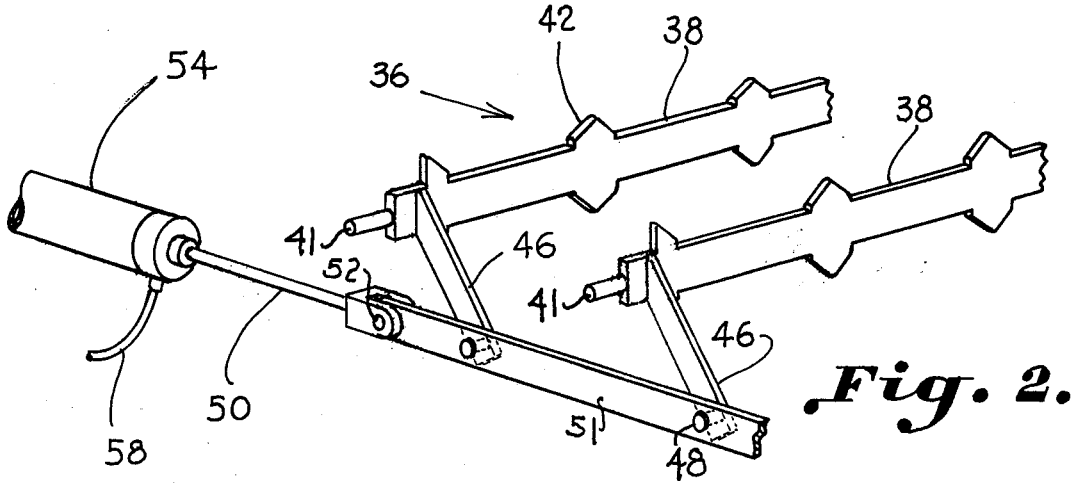
FIG. 2 is an enlarged perspective view illustrating camming mechanisms forming part of the article retarding device.

Normally, the case 14 is raised on an elevator such as illustrated in U.S. Pat. No. 3,788,034 to a position wherein the fingers 30 extend in the compartment of the case during the loading of the articles or bottles into the case. As can be seen in FIGS. 1 and 3, there is still quite a distance between the trip-bar assembly and the case, and if the bottles are allowed to drop directly through the grid set, they strike the bottom of the case quite hard. In order to break the fall of the bottles through the grid set, a cam means generally designated by the reference character 36 is carried adjacent the fingers so that when the cam means is in a first position such as illustrated in FIGS. 3 and 4, the fingers 30 are forced towards the center of the respective passages for stopping the downward movement of the bottles as the bottles drop through the passages. When the cam means is moved to the second position such as illustrated in FIGS. 1 and 2, the bottles 12 dropping through the passages force the fingers 30 back into the corners of the passages permitting the bottle to drop on through into the case.

In other words, as a result of manipulating the cam means 36, the bottles are first stopped in the position shown in FIG. 3. The cam means 36 is then moved to the second position as illustrated in FIGS. 1 and 2 allowing the bottles to pass through into the case. This breaks the fall of the bottles being loaded into the case thus reducing the noise normally accompanying the case packer as well as minimizing the breakage of bottles.

The cam means 36 includes a plurality of spaced rotatably supported elongated arms 38 each extending between a pair of side frame members 30. Rod-like extensions 41 are provided on the ends of the arms 38 and extend into holes provided in the frame members 40 so as to permit the arms to rotate. Cams 42 are provided on the arms 38 for engaging an apex 44 of the back side of the fingers 30. The camming surface 42 has diverging projecting angle surfaces **42*a* which terminate in right angle corners 42*b*. The purpose of the angle corners 42*b* is to receive the apexes 44 of the back side of the fingers when the camming surfaces 42 are rotated into engagement with the fingers. Connected to one end of the arms 38 are linkages 46 which are, in turn, pivotally secured at a pivot point 48 to a laterally extending bar 51 which connects all of the linkages 46** together.

One end of bar 51 is pivotally connected by means of a pin 52 to the end of piston rod 50. A pneumatically operated cylinder 54 is provided for manipulating the rod in and out from a retracted position such as illustrated in FIG. 3 to an extended position such as illustrated in FIG. 1.

The cylinder has ports 56 and 58 adjacent opposite ends thereof in which pressurized air is selectively fed. The cylinder 54 is, in turn, secured to a frame member by means of a bolt 60. When air is supplied to the port 56 of the cylinder 54, it causes the rod 50 to be extended to the position shown in FIG. 1 wherein the linkages 46 pivot the arms 38 so that the camming surfaces 42 point substantially vertically. When the camming surfaces point substantially vertically, the fingers 30 are permitted to be retracted into the corners of the passages permitting bottles 12 to drop therethrough. However, when air is supplied to the inlet port 58, the rod 50 is retracted to the position shown in FIG. 3 rotating the arms 38 in a clockwise direction causing the camming surfaces 42 to engage the rear corners of the fingers 44. This forces the fingers into the center of the respective passages and, as a result, when a bottle is dropped, it engages the arcuate surfaces **44*a*** of the fingers preventing the bottles from dropping into the case. As a result, the downward travel of the bottle is stopped.

Figure 5:
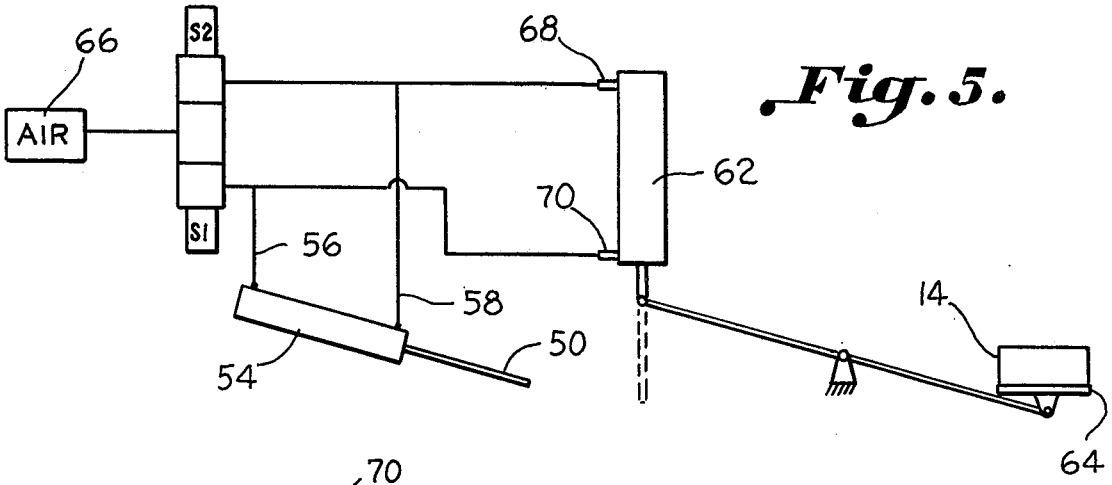
FIG. 5 is a schematic diagram of a pneumatic system forming part of the invention.
Figure 6:
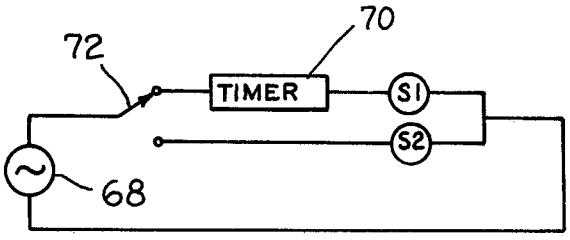
FIG. 6 is a schematic diagram illustrating an electric control circuit forming part of the invention.
Figure 7:
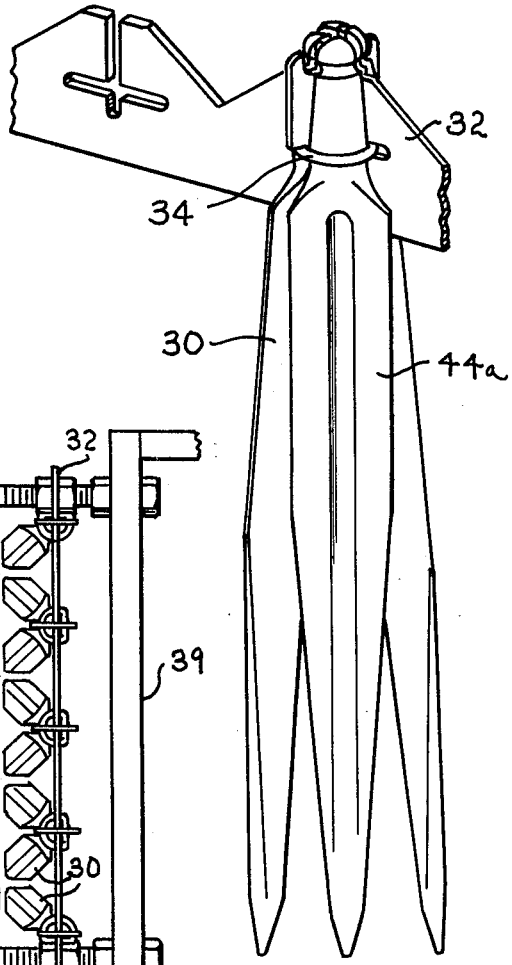
FIG. 7 is an enlarged perspective view illustrating the manner in which the fingers are supported.

From examining FIG. 2 which shows the camming means removed from the case packing machine, the positions that the camming surfaces assume can be readily ascertained. In FIGS. 5 and 6, there is illustrated in schematic form a pneumatic circuit and electrical circuit for controlling the operation of the camming means 42. The pressurized air for the cylinder 54 is received from the same lines that are connected to a cylinder 62 that is used for raising and lowering an elevator 64 upon which the case 14 that is to be loaded is carried. Solenoid operated valves S1 and S2 are interposed between a source of pressurized air 66 and input ports 68 and 70 of the elevator cylinder 62.

Either the solenoid value S1 or S2 is always energized when power is being supplied to the case packer. As illustrated in FIG. 6, solenoid valve S1 is connected in series with a source 68 of AC power. Interposed between the solenoid S1 and the source of power is a time delay device 70 and a switch 72. The switch 72 can be manipulated between two positions. When the switch 72 is in the position shown in FIG. 6, the solenoid valve S1 is energized through the time delay 70. When the switch 72 is in its lower position, the solenoid valve S2 is energized. The switch 72, as illustrated in FIG. 3, is carried on the frame of a case packer closely adjacent the trip-bar assembly so that it is shifted between its first and second position responsive to the position of the trip-bar. The switch 72 assumes the position shown in FIG. 6 when the trip-bar 18 is shifted to the right such as illustrated in FIG. 3 when dropping the bottles.

At the moment that the bottles are dropped, the fingers are in the closed position such as illustrated in FIGS. 3 and 4, therefore, the bottles 12 are caught by the fingers. After a very short duration, depending on the operating speed of the machine, the timer 70 times out energizing solenoid valve S1. When solenoid valve S1 is energized, air is supplied to the input port 70 of cylinder 62 retracting the piston associated therewith causing the elevator 64 to be lowered. Also, when solenoid S1 is energized, air from the pressurized source 66 is fed to port 56 of cylinder 54 causing the rod 50 to be extended. When the rod 50 is extended, the arms 38 upon which the camming surfaces 42 are carried are rotated counter-clockwise so that the camming surfaces assume a substantially vertical position. When this occurs, the fingers 30 are pivoted back into the corner of the passages allowing the bottles to be deposited into the case. The bottles are deposited into the case at substantially the same time that the elevator begins to be lowered.

While the camming arms 38 and surfaces 42 are illustrated and described in connection with a case packer wherein an elevator 64 raises an empty case upwardly to a fixed grid set, they can also be used on a case packer wherein the case remains stationary and the grid set and fingers are lowered to the empty case. In such a device the camming device would be lowered with the grid set.

While a preferred embodiment of the invention has been described using specific terms, such description is for illustrative purposes only, and it is to be understood that changes and variations may be made without departing from the spirit or scope of the following claims.

What is claimed is:

1. An article retarding device for use with a grid set forming part of a case loader, said grid set including a plurality of elongated spaced members being spaced apart sufficiently for allowing said articles to pass therebetween, guide members spaced along said elongated spaced members defining square passages through which said articles pass for loading into a case carried below said grid set, said guide members including elongated downwardly extending rigid fingers pivotally attached adjacent the corners of said passages with the lower ends thereof extending downwardly below said spaced members, and rear surfaces of said fingers intersecting at a right angle, said article retaining device comprising:

cam means carried adjacent said finger;

said cam means including:

(i) a plurality of spaced elongated arms each extending adjacent a respective group of downwardly extending fingers, and (ii) right angle longitudinally spaced caming surfaces each projecting outwardly from said arms towards a respective finger, means for placing said cam means in a first position wherein said right angle caming surfaces engage the rear surfaces of a respective finger forcing said fingers towards the center of said respective passages for stopping the downward movement of said articles as said articles are dropped through said passages when said trip bar assembly is shifted, and means for retracting said cam means to a second position allowing said fingers to be retracted back into the corners of said passages permitting said articles to drop into said case.

2. An article retarding device for use with a grid set for breaking the fall of articles as they are dropped through said grid set into a case, said grid set including a trip-bar assembly onto which said articles are fed, means for shifting said trip-bar assembly for dropping said articles towards said case carried therebelow, a plurality of pivotally supported downwardly extending fingers carried in the form of a matrix below said trip-bar assembly, said downwardly extending fingers being arranged so that there is a finger in each corner of a passage through which said articles drop when being loaded into said case, said article retarding device comprising:

cam means carried adjacent said fingers;

means for placing said cam means in a first position in engagement with said fingers forcing said fingers diagonally towards the center of said respective passages wherein four equally spaced fingers engage said article for stopping the downward movement of said articles as said articles are dropped through said passages when said trip-bar assembly is shifted; and means for retracting said cam means to a second position allowing said fingers to be retracted back into the corners of said passages permitting said articles to drop into said case.

3. The article retaining device as set forth in claim 2 wherein said cam means comprising:

a plurality of spaced elongated arms each extending adjacent a respective group of downwardly extending fingers;

longitudinally spaced camming surfaces each projecting outwardly from said arms towards a respective finger; and said means for selectively moving said cam means including:

(i) an elongated bar carried adjacent one side of said grid set, (ii) linkages connecting said elongated arms to said elongated bar, and (iii) means for shifting said elongated bar rotating said elongated arms causing said camming surfaces to move from a retracted position to a position wherein they engage said fingers forcing said fingers to the center of a said respective passage.

4. The article retaining device as set forth in claim 3 wherein said camming surfaces are carried adjacent a rear portion of said fingers distal from the center of said passages for forcing a lower portion of said fingers towards the center of said passages when said cam means are moved into engagement with said fingers.

5. The article retarding device as set forth in claim 2 wherein said means for placing said cam means in said first and second position comprises:

a power operated cylinder having first and second spaced ports;

a piston operated rod extending out one end of said cylinder;

means for operably connecting said rod to said cam means;

a source of pressurized fluid;

means for selectively connecting said source of pressurized fluid to said first port causing said cam means to assume said first position; and means for selectively connecting said source of pressurized fluid to said second port causing said cam means to assume a second position.

* * * * *